United States Patent [19]

Lenander

[11] Patent Number: 4,474,282

[45] Date of Patent: Oct. 2, 1984

[54] COIN-OPERATED LOCK FOR A TROLLEY SYSTEM INCLUDING ESPECIALLY SHOPPING AND LUGGAGE TROLLEYS

[75] Inventor: Aage Lenander, Rungsted Kyst, Denmark

[73] Assignee: Catena-Locks A/S, Kokkedal, Denmark

[21] Appl. No.: 403,653

[22] PCT Filed: Nov. 30, 1981

[86] PCT No.: PCT/DK81/00108

§ 371 Date: Jul. 15, 1982

§ 102(e) Date: Jul. 15, 1982

[87] PCT Pub. No.: WO82/01951

PCT Pub. Date: Jun. 10, 1982

[30] Foreign Application Priority Data

Nov. 28, 1980 [DK] Denmark ..... 5090/80

[51] Int. Cl.[3] ..... G07F 7/02

[52] U.S. Cl. ..... 194/1 E; 194/4 D

[58] Field of Search ..... 194/4 D, 4 G, 4 R, 55, 194/2, 1 A, 1 R, 64, 1 E, 4 E, 4 C

[56] References Cited

U.S. PATENT DOCUMENTS 3,197,008 7/1965 Moore ..... 194/64

*Primary Examiner*—Stanley H. Tollberg

*Attorney, Agent, or Firm*—Silverman, Cass & Singer

[57] ABSTRACT

A coin-operated lock for mounting on a trolley which is alternatively secured and released. The lock has two keyholes for two separate keys having interacting blocking means formed by codification units so that only keys having interacting, fitted codes can be mutually displaced when cooperating with their respective keyholes.

9 Claims, 11 Drawing Figures

Figure 1:
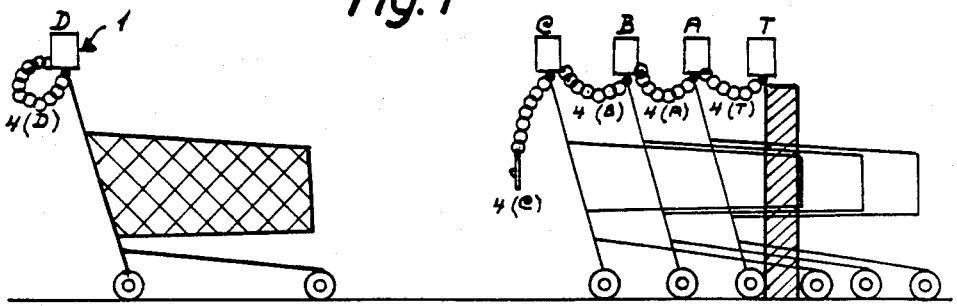

COIN-OPERATED LOCK FOR A TROLLEY SYSTEM INCLUDING ESPECIALLY SHOPPING AND LUGGAGE TROLLEYS

The invention relates to a coin-operated lock adapted for installation on a trolley being part of a system of such trolleys, especially shopping and luggage trolleys. The coin-operated lock is arranged for release of a secured trolley by insertion of a coin, and for repayment of the amount deposited when the trolley is returned, the lock having two blockable keyholes for accepting separate keys, one of which is anchored to the trolley on which the lock is mounted. The lock is further arranged so that when a coin is inserted, one keyhole is released for accepting and securing the said key anchored to the same trolley, so that the other keyhole secures a key belonging to another trolley or a coupling unit, so that the other keyhole—when the said key anchored to the same trolley is inserted in the former keyhole—is released for release of the said key secured therein and anchored to the same trolley and for repayment of the coin when the other key is inserted in the other keyhole.

Release and anchoring of the trolley is thus done by simple insertion and withdrawal of a key into and from a keyhole. The keys are suitably fixed to the trolleys by a chain. Interlocking of trolleys is not dependent on their completely correct alignment mutually or with the coupling unit.

The key system also permits a special simple embodiment since at any rate the keys belonging to the trolleys can be arranged as a carrier for the coin, and the said former keyhole can be arranged for only accepting a key carrying a coin. It means that payment and insertion of the key belonging to the same trolley can be combined.

In cases where several enterprises, e.g. supermarkets using trolleys of the above mentioned kind, are situated close to each other, possibly with access to the same parking lot for customer cars, undesirable mixing of abandoned empty trolleys often takes place which means sorting work and difficulty in separating the trolleys of each enterprise.

The object of the invention is to show how a group of trolleys can be gathered separately in an easy way without being mixed with trolleys from one or more other groups.

This object has according to the invention been achieved in the way that the keys designed for insertion in the keyholes have interacting blocking means adapted as codification units which only permit insertion and withdrawal respectively of a key if the code of this key is the same as that of another key so that only keys fitting together can be moved relative to each other for insertion or withdrawal purposes.

The result is that the above mentioned interaction between the keys is only permitted between pairs of keys whose codes allow the movements of keys relative to each other which are necessary to make the lock work. The use of different codes for the trolleys of different enterprises will thus prevent trolleys from different enterprises being coupled together.

According to the invention a simple embodiment of the keys is that they are made as insertion units and that the blocking means are shaped as projections. A very simple embodiment is according to the invention that the projections are shaped as ribs having projections and recesses at their free outer edge. It means that the keys can be standardized with a standard rib, and the codification is then produced e.g. by the rib top being provided with cut notches so that a code is formed which consists of projections and notches.

Another expedient embodiment of the keys is according to the invention that the blocking means are also shaped as handling devices for operation of the keys so that they can be handled easily and safely.

For this purpose the blocking means can according to the invention be embossed so that they form a grooved rib.

Figure 2:
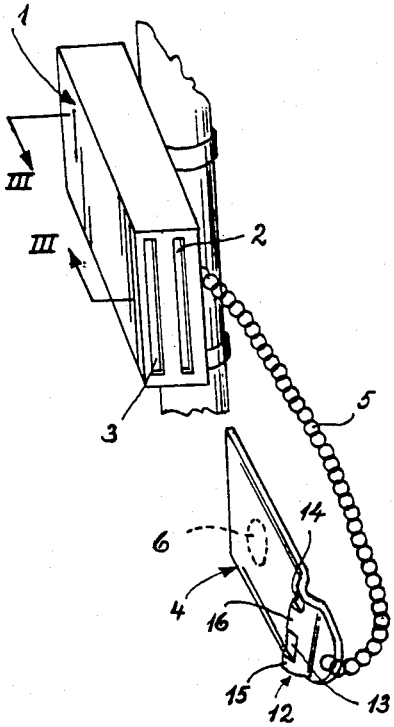
Figure 3:
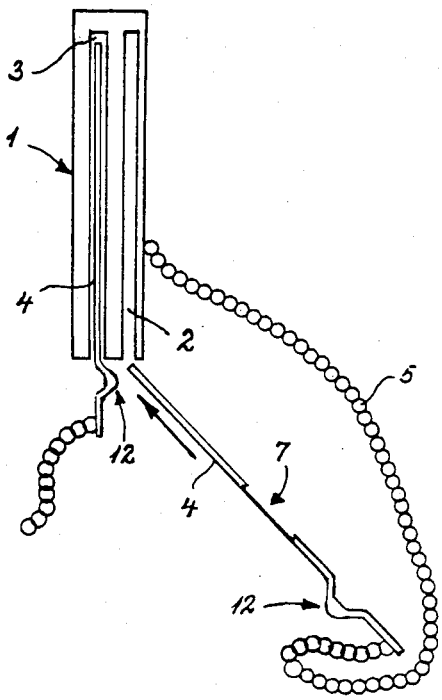
Figure 4:
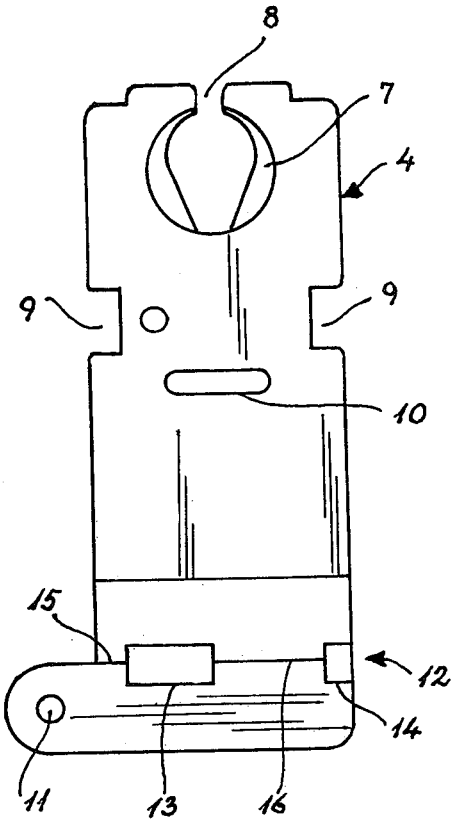
Figure 5:
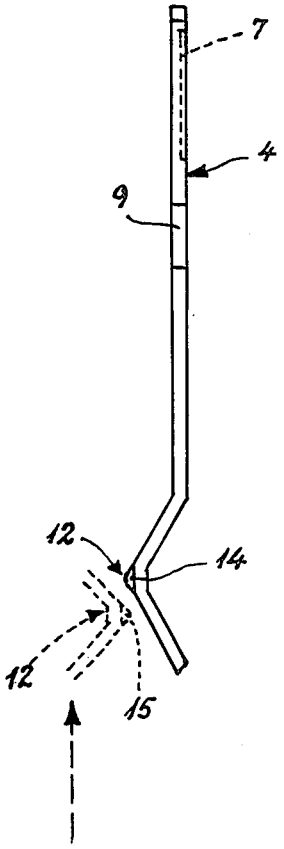
Figure 6:
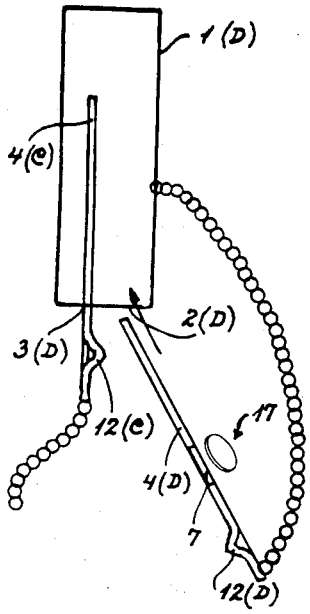

In what follows, the invention will be explained in detail with reference to the drawing in which FIG. 1 shows an arrangement of four shopping trolleys, each provided with an embodiment of the coin-operated lock, according to the invention, so that two of the trolleys are mutually anchored, the third trolley is anchored to a coupling unit, and the fourth trolley is released, FIG. 2 on a larger scale is an oblique picture seen from below this lock, FIG. 3 is a schematic representation through the lock along line III—III in FIG. 2, with a key inserted in the lock and a key about to be inserted into the lock, FIG. 4 is an embodiment of a key with codification units seen from above, FIG. 5 is the same embodiment seen from one side, and FIG. 6–11 are schematic representations of the coin-operated lock with keys in different positions of function.

FIG. 1 shows an arrangement of four trolleys, A, B, C and D. Of these four trolleys, A is anchored to a coupling unit T, e.g. in the form of a stanchion or a wall. The trolley B is anchored to trolley A, trolley C is anchored to trolley B, and trolley D is released from its anchoring to trolley C.

Each of the trolleys A–D has a coin-operated lock in a box-shaped housing 1, at one end of which there are two keyholes 2 and 3. A key 4 belongs to the coin-operated lock and can be inserted and secured in keyhole 2. This key 4 is fixed through chain 5 to the housing 1 or the trolley to which the housing is fixed. On the present embodiment the key 4 is also designed as a carrier for a coin since it has a recess 7 corresponding to the coin.

The key 4 is shaped as a tongue for insertion, at the insertion end of which there is a recess 8 with access from the outside. This access extends into the key through the bottom of recess 7. In the embodiment shown in FIG. 4 the recess spans diametrically over a major portion of this bottom. However, it may also be somewhat shorter or longer so that it reaches only some distance into the bottom or some distance past the bottom.

Key 4 also has some side notches 9 and a fence opening 10 which a fence belonging to the coin-operated lock can engage.

The key has an eye 11 at its handling end to which the chain 5 can be fixed. At the same end the key has an embossed ridge which forms a grooved rib 12 across the key, the opening of the groove being open in the same direction as the recess 7.

As shown, especially in FIG. 2, keyholes 2 and 3 are placed opposite to each other so that also the keys 4 inserted in these openings are opposite to each other. Moreover, the arrangement is so that the keys can only be inserted in keyholes 2 and 3 with the ribs 12 facing each other. Furthermore, the ribs of keys 4 made by embossing have together a height which is larger than the distance between openings 2 and 3. It means that at a predetermined point of the displacement route the key ribs will collide at the upper end of their broad sides facing each other and thus prevent a further relative displacement between the keys unless special arrangements are made which permit the key ribs to pass each other.

For this purpose the rib edges have transverse cut recesses, in the present case a wide recess 13 and a narrow recess 14 so that a narrow projection 15 and a wide projection 16 are left in the rib ridge. The width of the projection 15 measured in the transverse direction of the key is somewhat smaller than that of recess 14, and the corresponding width of projection 16 is somewhat smaller than that of recess 13.

When two keys 4 in the position indicated with the ribs facing each other are to be displaced relative to each other so that the ribs can pass each other, projections 15 and 16 of one key can then pass the corresponding recesses of the other key, 13 and 14 respectively, as indicated in dotted lines in FIG. 5.

It means that depending on the number and shape of recesses and corresponding projections it is possible to provide a code so that only two keys fitting together in the manner described can be used for release and return respectively of a trolley. It is thus possible on the basis of the same coin-operated lock to impart different codes to different groups of trolleys which are to be released or collected separately so that mixing of the trolleys from e.g. different enterprises such as supermarkets can be avoided.

The arrangement works in detail as follows:

When the rearmost trolley D of a row of trolleys A, B, C, D which are anchored to the coupling unit T is to be released from the row, see FIG. 1, a coin 17 is to be inserted in the recess 7 of key 4(D) of trolley 4. The key 4(D) is then inserted into keyhole 2(D) of housing 1(D) fixed to trolley D. See FIGS. 6 and 7. The key 4(C) belonging to trolley C is already anchored to this lock housing 1(D), see FIGS. 6 and 7, since it is inserted in keyhole 3(D) of housing 4(D) where it is secured by the fence of lock 1(D).

Both the keys 4(D) and 4(C) have ribs 12 with corresponding code-forming projections and recesses, as described in the foregoing. Besides, the arrangement is such that the keys 4 can only be inserted in keyholes 2 and 3 with the ribs 12 facing each other. See FIG. 10.

Figure 7:
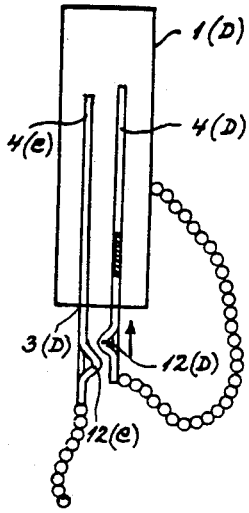
Figure 8:
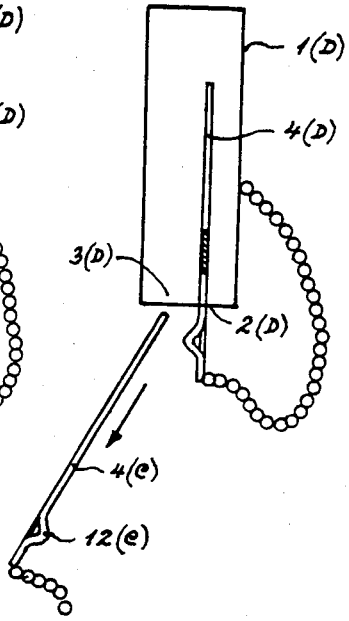

When key 4(D) is inserted so far into keyhole 2(D) that rib 12(D) of this key has passed rib 12(C) of key 4(C) secured in keyhole 3(D) in direction towards the lock housing, see FIG. 7, the fence of lock 1(D) is released by actuation partly directly by key 4(D), partly by the coin 17 inserted in key 4(D) so that the fence releases key 4(C) and secures key 4(D), cf. FIG. 8, whereupon key 4(C) can be removed from keyhole 3(D) of trolley D and trolley D is released, cf. FIG. 1. The trolley can then be moved around freely with its own key 4(D) and the coin 17 inserted therein secured in lock housing 1(D).

Figure 9:
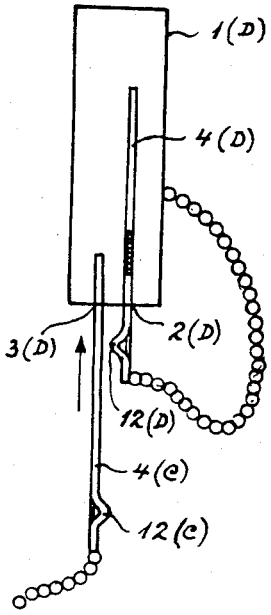
Figure 10:
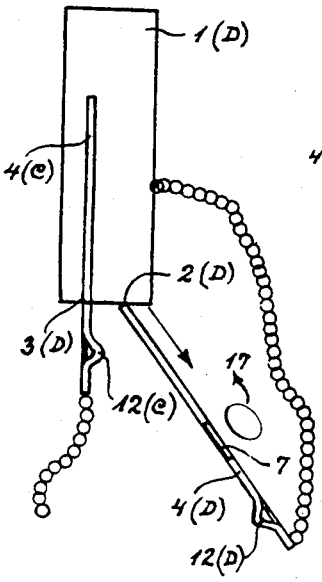
Figure 11:
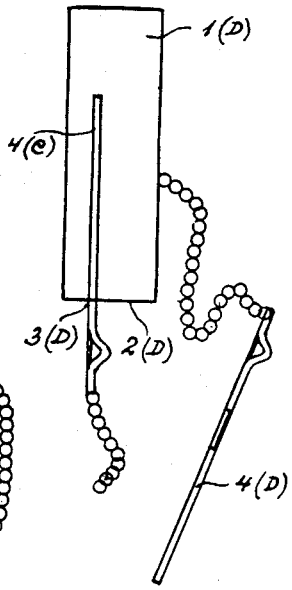

When the trolley D is returned to a row of trolleys or direct to coupling unit T, the key of the rearmost trolley of the row or of the coupling unit T, in the example shown in FIG. 1 the key 4(C) of trolley C, is re-inserted in keyhole 3(D) of trolley D, see FIG. 9, until rib 12(C) of key 4(C) has passed rib 12(D) of key 4(D) anchored in lock housing 1(D) which can be done freely since both ribs 12(C) and housing 12(D) have corresponding blocking codes. The same conditions would exist for the keys 4 of the other trolleys of the row as well as for the key of the coupling unit T. When key 4(C) has been inserted completely, it will actuate the fence of lock 1(D) so that it partly releases the key 4(D) of trolley D itself, partly detains key 4(C) of trolley C. See FIG. 10. Key 4(D) can be removed from lock housing 1(D), and the coin 17 can be removed from key 4(D) again. Trolley D is then coupled to the row of trolleys again and is ready for renewed hiring. See FIG. 11.

I claim:

1. A coin-operated lock adapted for installation on a trolley being part of a system of such trolleys, especially shopping and luggage trolleys, said lock being arranged for release of a secured trolley by insertion of a coin, and for repayment of the amount deposited when the trolley is returned, the lock having two blockable keyholes for accepting separate keys, one of which being anchored to the trolley on which the lock is mounted, the lock being further arranged so that when a coin is inserted, one keyhole is released for accepting and securing the said key anchored to the same trolley, so that the other keyhole secures a key belonging to another trolley or a coupling unit, so that the other keyhole—when the said key anchored to the same trolley is inserted in the former keyhole—is released for release of the other key, and so that the former keyhole is released for release of the said key secured therein and anchored to the same trolley and for repayment of the coin when the other key is inserted in the other keyhole, characterized in that keys (4) adapted for insertion into keyholes (2 and 3) have interacting blocking means (12) adapted as codification units (13, 14, 15, 16) which only permit insertion and withdrawal respectively of a key (4) if the code of this key fits together with the code of the other key so that only keys fitting together can be moved relative to each other for insertion and withdrawal purposes respectively.

2. A coin-operated lock as claimed in claim 1, characterized in that keyholes (2 and 3) are positioned relative to each other so that the inserted keys (4) are opposite to each other, that keys (4) have at least one blocking means (12) which projects from keys (4) in a direction transverse of the insertion direction of keys (4), and that lock (1) and keys (4) are arranged for insertion of keys (4) with their blocking means (12) facing each other, said blocking means (12) being arranged as codification units (13, 14, 15, 16) for either permitting keys (4) to move relative to each other or for blocking their mutual passage.

3. A coin-operated lock as claimed in claims 1 or 2, characterized in that keys 4 are shaped as insertion units and that said blocking means (12) are shaped like projections.

4. A coin-operated lock as claimed in claim 3, characterized in that the projections are shaped like ribs (12), the free outer edge of which being provided with projections (15 and 16) and recesses (13 and 14).

5. A coin-operated lock as claimed in claim 1, characterized in that the blocking means are also shaped like handling units for operation of keys (4).

6. A coin-operated lock as claimed in claim 5, characterized in that the blocking means (12) are shaped like an embossed shoulder shaped as a groove forming rib.

7. A coin-operated lock as claimed in claim 1, characterized in that a recess (7) for a coin is located in keys (4)

between blocking means (12) and the insertion end of the keys.

8. A coin-operated lock as claimed in claim 3, wherein the blocking means are also shaped like handling units for operation of said keys.

9. A coin-operated lock as claimed in claim 3, wherein a recess for a coin is located in said keys between said blocking means and the insertion end of said keys.

* * * * *